United States Patent [19]

Christensen

[11] 4,316,058

[45] Feb. 16, 1982

[54] SOUND FIELD TRANSMISSION SYSTEM SURROUNDING A LISTENER

[75] Inventor: Roy M. Christensen, Titusville, N.J.

[73] Assignee: RCA Corporation, New York, N.Y.

[21] Appl. No.: 251,836

[22] Filed: May 9, 1972

[51] Int. Cl.[3] ..... H04S 3/00; H04H 5/00

[52] U.S. Cl. ..... 179/1 GQ; 179/1 GD

[58] Field of Search ..... 179/1 GQ, 15 BT, 1 GH, 179/100.1 TD, 100.4 ST, 1 GD; 369/89, 90

[56] References Cited

U.S. PATENT DOCUMENTS

| | | | |
|---|---|---|---|
| 3,257,511 | 6/1966 | Adler | 179/15 BT |
| 3,375,329 | 3/1968 | Prouty | 179/15 BT |
| 3,679,832 | 7/1972 | Halpern | 179/15 BT |
| 3,708,623 | 1/1973 | Dorren | 179/15 BT |

OTHER PUBLICATIONS

Quadrasonics on the Air, Feldman Audio, Jan. 1970.

The Quart Broadcasting System, Gerzon Audio, Sep. 1970.

Report of Dorren Quadraplex System, Public Information, Aug. 1971, pp. 1–5.

*Primary Examiner*—Douglas W. Olms

*Attorney, Agent, or Firm*—Eugene M. Whitacre; William H. Meagher

[57] ABSTRACT

Systems for uniformly reproducing a sound field surrounding a listener are disclosed utilizing three channels of audio information signals. One channel provides signals representative of total sound pressure (a sum signal) and the two remaining channels provide orthogonal pressure gradients (difference signals) representative of location of sound sources which produce the sound field. FM radio systems utilizing the three channel technique for providing surround stereophonic sound are also described.

13 Claims, 2 Drawing Figures

SOUND FIELD TRANSMISSION SYSTEM SURROUNDING A LISTENER

Figure 1:
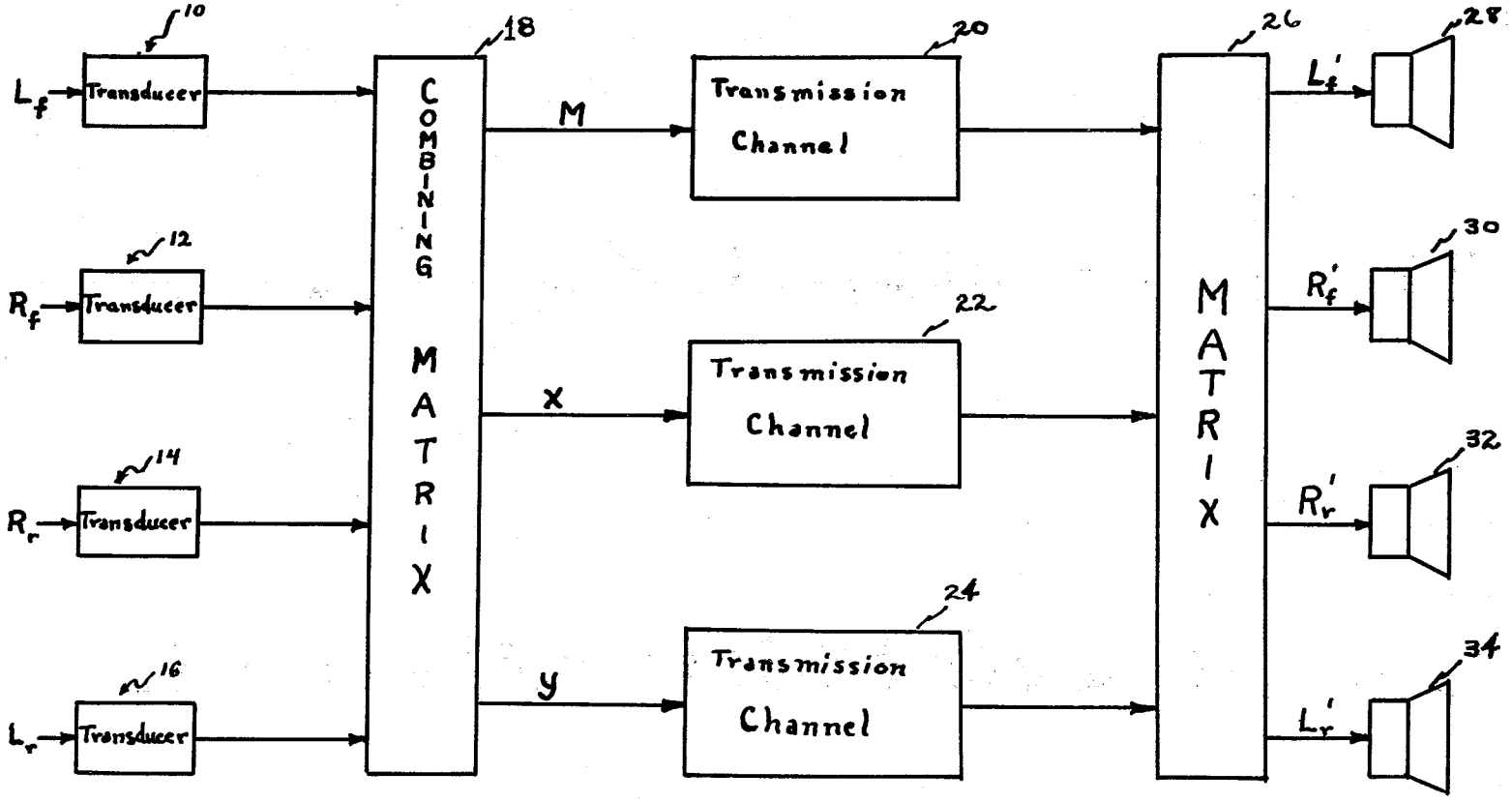

This invention relates to systems for recreating a sound field surrounding a listener and, in particular, to such a system which is compatible with FM two channel stereophonic broadcast standards presently employed in the United States and elsewhere.

The system to be described contemplates transmission of four items of inter-related audio information over three signal channels.

Numerous systems have recently been proposed for storage and/or transmission of surround stereophonic sound information. In general, such systems pre-suppose the existence of four independent sound quantities corresponding, for example, to sounds which would be reproduced in four loudspeakers placed either in four corners of a listening room (a square arrangement) or midway along the walls of such a room (a diamond speaker arrangement). In each case, the sound quantities (amplitudes) are identified by the speaker location vis-a-vis a listener. Thus, in one case reference is made to left front ($L_f$), right front ($R_f$), right rear ($R_r$) and left rear ($L_r$) sound channels whereas, in the other case, reference is made to front (F), right (R), back (B) and left (L) sound channels. Among the many systems proposed for recreation of surround stereophonic sound, most fall into either of two categories which are referred to in the art at present as "4-2-4" matrix systems or discrete 4-channel systems. The former are particularly suited for encoding four channels (as defined in one of the above arrangements) of sound information for storage in two signal channels such as the walls of a conventional phonograph record. Upon playback, the two channel information is "de-matrixed" to drive four loudspeakers. It is undisputed that in every such 4-2-4 matrix system, some information included in the original four sound channels is not reproducible in the loudspeakers of the reproducing system.

In the case of previously proposed discrete four channel systems, all of the original information can be reproduced. However, each such system involves multiplexing techniques which require the use of a frequency spectrum substantially greater than the audio frequency spectrum of the original information. Some of these discrete four channel system proposals have been directed specifically towards FM radio broadcast. In each such case, in order to include four full audio bandwidth channels in the transmitted signals, it has been necessary to extend the frequency range of the main modulated signal beyond the limit of 53 KHz employed for audio information in current two channel stereophonic FM broadcast signals. The use of these higher modulating frequencies for surround stereophonic information precludes their use as a privileged communications channel ("SCA") in the manner presently employed in the United States. It is also known that this higher frequency portion of the available main carrier modulating spectrum is more susceptible to noise than is the lower frequency portion thereof. Audio information carried, for example, as amplitude modulation of a subcarrier at frequencies above 53 KHz would therefore be expected to be relatively more contaminated with noise components than the currently employed stereophonic (L+R) sum signal (0 to 15 KHz) and difference signal (23 KHz to 53 KHz) channels.

In the case of each of the two types of four channel systems described above, considerable effort has been expended in attempting to provide channel "separation" or isolation of single location sound sources. In the case of the 4-2-4 matrix systems, pursuit of the goal of separation has resulted in systems which produce anomalies or "holes" in the reproduced sound field. In the case of discrete four channel systems, as noted above, separation is obtained at the expense of frequency spectrum and, in some cases, increased noise in some channels.

In accordance with one aspect of the present invention, a system for reproducing a surround stereophonic sound field uniformly comprises means for supplying three channels of signals each containing audio information. One of the channels is arranged so as to provide signals representative of total sound pressure (amplitude) and the two remaining channels are arranged to provide orthogonal pressure gradients (directions) in a sound field. For example, utilizing the nomenclature set forth above in connection with a "square", four speaker arrangement in a listening room, the first of the channels includes sound information according to the expression:

$$M = L_f + R_f + R_r + L_r,$$

that is the sum or total sound pressure. A second channel includes sound information according to the expression:

$$X = L_f + R_f - R_r - L_r,$$

that is, the difference between front and back information. The third channel includes information according to the expression:

$$Y = L_f - R_f - R_r + L_r,$$

that is, the difference between left side and right side information.

A sound reproducing system of the designated type further comprises means for combining the M, X and Y signals to recreate a sound field in terms of, for example, left front ($L_f'$), right front ($R_f'$), right rear ($R_r'$) and left rear ($L_r'$) loudspeaker energization signals defined according to the expressions:

$$L_f' = M + AX + BY$$

$$R_f' = M + CX - DY$$

$$R_r' = M - EX - FY$$

$$L_r' = M - GX + HY,$$

where the coefficients A through H are chosen to provide desired relative contributions of particular loudspeakers.

In accordance with a further aspect of the present invention, means are provided in an FM broadcast radio system for supplying a composite surround stereophonic signal including the above-defined audio signal components M, X and Y. Specifically, such composite signal supplying means is arranged to supply the sum signal component (M) extending over a frequency range of approximately 20 to 15,000 Hz, a 19 KHz pilot subcarrier, the difference between left side and right side audio information (Y) impressed as double sideband amplitude modulation on a first 38 KHz suppressed subcarrier wave in a first timed relation with the 19

KHz pilot and the difference between front and back audio information (X) impressed as double sideband amplitude modulation on a second 38 KHz suppressed subcarrier wave in quadrature (90°) phase relationship with the first 38 KHz subcarrier. In each case, the sidebands preferably extend over a frequency range of 23 KHz to 53 KHz. The receiver further comprises means for synchronously detecting the specified X and Y signals and for recombining such detected signals with the main (M) channel signal to recreate the original sound field, for example, in accordance with the previously defined expressions $L_f'$, $R_f'$, $R_r'$, $L_r'$.

Figure 2:
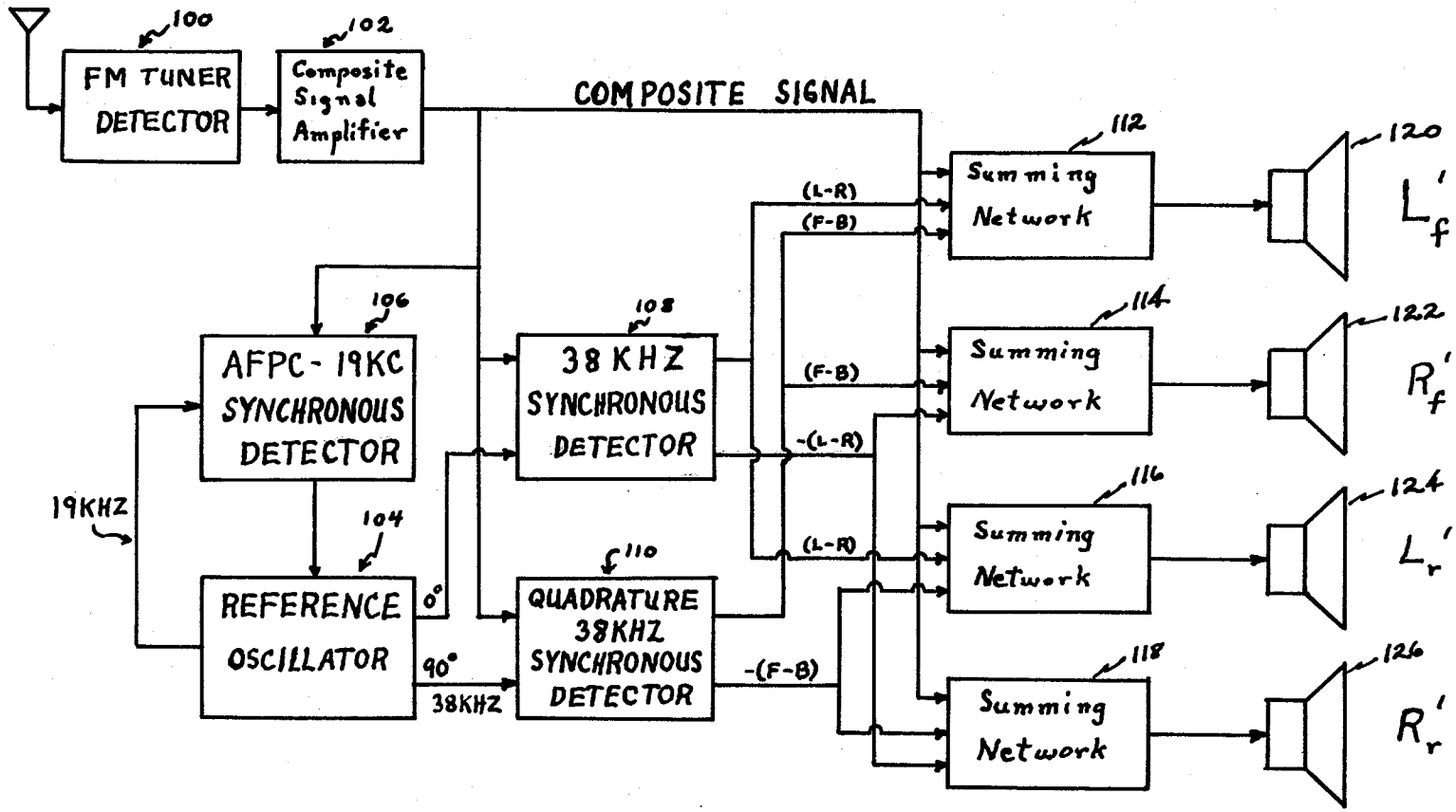

For a better understanding of the present invention, reference should be made to the following description in connection with the attached drawing, in which:

FIG. 1 is a block diagram of a system, utilizing three transmission channels, for recreating a sound field surrounding a listener, and FIG. 2 is a block diagram of a portion of an FM radio receiver suitable for recreating, from three channels of transmitted information, a sound field surrounding a listener.

Referring to FIG. 1, a plurality of transducers such as microphones 10, 12, 14 and 16 are arranged to convert into electrical signals sound pressure information representative of sound waves arriving at a region in space from orthogonal directions represented as left front ($L_f$), right front ($R_f$), right rear ($R_r$) and left rear ($L_r$). Alternatively, the transducers 10, 12, 14 and 16 may be magnetic pickups associated with respective tracks on magnetic recording tape (or a like medium) on which the audio information signals previously have been recorded. Electrical output signals from transducers 10, 12, 14 and 16 are coupled to a combining matrix 18 which, in simplest form may consist of appropriate summing resistances and/or amplifiers for combining the four signals $L_f$, $R_f$, $R_r$ and $L_r$ according to the expressions:

$$M=L_f+R_f+R_r+L_r \quad (1)$$

$$X=L_f+R_f-R_r-L_r \quad (2)$$

$$Y=L_f-R_f-R_r+L_r \quad (3).$$

The three signals so derived are representative of a total sum or sound pressure signal (M), a front to back directional signal (X) and a left to right directional signal (Y). Each of the signals M, X and Y is conveyed by means of a separate transmission channel 20, 22, 24 from combining matrix 18 to a second matrix 26. Matrix 26, like matrix 18 may comprise a plurality of resistors and/or amplifiers for converting the three separate signals M, X and Y to four appropriate signals $L_f'$, $R_f'$, $R_r'$ and $L_r'$ for driving loudspeakers 28, 30, 32 and 34 arranged around a listener, for example, in a square pattern. The matrix 26, for example, may be arranged to satisfy the following expressions:

$$L_f'=M+X+Y \quad (4)$$

$$R_f'=M+X-Y \quad (5)$$

$$R_r'=M-X-Y \quad (6)$$

$$L_r'=M-X+Y \quad (7).$$

Substituting for the values of M, X and Y in the above expressions, from equations (1), (2) and (3), it can be seen that, for example, where the original signals provided by transducers 10, 12, 14 and 16 represent a unity $L_f$ signal, the matrix 26 provides outputs to the four loudspeakers 28, 30, 32 and 34 having amplitudes of 3 units, 1 unit, −1 unit and 1 unit, respectively. The resulting signals reproduced by loudspeakers 28, 30, 32 and 34 therefore will provide directional information ($L_f'$) corresponding to the directional information of the original signal ($L_f$), the reduced but equal responses of the flanking speakers 30 and 34 ($R_f'$, $L_r'$) producing a nondirectional standing wave along a spatial axis orthogonal to the direction of the sound source ($L_f'$). The out-of-phase excitation of the opposite speaker 32 ($R_r'$) does not affect directionality of the desired sound source but may be considered objectionable. This excitation of speaker 32 may be eliminated by providing appropriate relative gains for the signal components M, X and Y in matrix 26. For example, if the gains provided for the X and Y signals are chosen equal but one-half that of the M signal in matrix 26, simple algebra will demonstrate that the opposite speaker (e.g., 32) will not be energized for the condition where the original signal appeared only in one channel (e.g., $L_f$). The flanking loudspeakers (30 and 34) in the latter case are, however, now energized with signal voltages equal to each other but one-half that of the speaker 28 for an original $L_f$ only signal.

Similar results are obtained for single channel signals in each of the transducers 12, 14 and 16, the system exhibiting like responses in all four quadrants. This characteristic of the system avoids anomalies encountered in 4-2-4 matrix systems. Furthermore, it becomes apparent from consideration of the system equations set forth above that, if all four transducers 10, 12, 14 and 16 are excited with identical signals, only the "M" transmission channel 20 will carry information, the "X" and "Y" channels 22 and 24 will not carry any. This situation will result in production by loudspeakers 28, 30, 32 and 34 of equal sound outputs. The resultant standing wave pattern produced in the listening room is considered to be a desirable listening condition for a surround stereophonic reproduction system. Other attributes of the system of FIG. 1 will be described below in connection with its application to FM radio reproducing systems of the type shown in FIG. 2.

The FM radio receiver to be described contemplates an FM broadcast standard for compatible transmission of monophonic, two channel stereophonic and surround stereophonic sound signals. As is the case with current two channel stereophonic transmissions, the contemplated standard involves a composite signal having frequency components extending over the range of 20 Hz to 53 KHz and including an audio sum signal between 20 Hz and 15 KHz, a 19 KHz pilot signal, and a stereophonic difference signal (L-R) impressed as double sideband amplitude modulation on a 38 KHz suppressed subcarrier which is generated in predetermined time relation with respect to the 19 KHz pilot signal. Additionally, in accordance with the present invention, surround stereophonic information is provided in the form of a front-back (F-B) difference signal impressed as double sideband amplitude modulation on a second suppressed 38 KHz subcarrier, the latter being in quadrature (90°) phase relationship with the normal stereophonic subcarrier. In order to take into account the presence of four audio signals in the contemplated system, the sum signal is provided by the signal "M" previously defined in connection with FIG. 1. The quadrature or surround stereophonic subcarrier is modulated with the signal "X" as previously defined and the stereophonic subcarrier is modulated by the signal "Y" as previously defined in connection with FIG. 1.

Referring to FIG. 2, the illustrated FM radio receiver is similar in large part to a two channel stereophonic receiver of the type shown, for example, in U.S. patent application Ser. No. 218,786. Reference may be made to that application for suitable detailed circuits. The receiver comprises an FM radio tuner and second detector 100 of conventional form for selectively receiving, amplifying and detecting FM broadcast material. The FM tuner and detector 100 delivers an audio frequency signal when non-multiplex, monophonic broadcasts are received, a composite stereophonic signal when two channel stereophonic broadcasts are received and a composite surround stereophonic signal when that type of broadcast is received. In any of these instances, SCA signals reposing between 53 and 75 KHz in the detected signal spectrum may accompany the other signals. For convenience, the signal supplied by tuner-detector 100 will be referred to as a composite signal.

The detected composite signal output of tuner-detector 100 is coupled to a composite signal amplifier 102 which is arranged to amplify signals in the range of approximately 10 Hz to 150 KHz so as to produce first and second substantially identical but 180° out of phase (i.e., push-pull) amplified composite signals for direct application to various following circuit elements.

The radio receiver further comprises a controlled reference oscillator 104 arranged to operate at a frequency harmonically related to 19 KHz and 38 KHz. The particular frequency is selected preferably to permit generation, by means of binary frequency dividers (and associated logic circuitry) of at least two 38 KHz subcarriers in quadrature phase relationship and a 19 KHz wave in suitable time relationship therewith for use in an automatic frequency and phase control (AFPC) loop. The AFPC loop is provided by means of an AFPC 19 KHz synchronous detector 106 to which at least the 19 KHz pilot signal component of the composite signal is coupled. In addition, synchronous detector 106 is provided with composite signal outputs from amplifier 102 (preferably in balanced form) and with balanced nominal 19 KHz outputs from the reference oscillator 104. A differential direct voltage representative of the phase difference between the received pilot signal component and the nominal 19 KHz waveform derived from oscillator 104 is developed across an appropriate low pass filter network (not shown) for coupling to oscillator 104 to correct the operating phase and frequency thereof in a known manner.

Additional binary frequency divider and logic apparatus provided within reference oscillator 104 are arranged to generate, in a known manner, the required 38 KHz subcarrier waveform for detection of the stereophonic audio difference (L-R) signal components from the appropriate received sidebands of the 38 KHz suppressed stereophonic subcarrier signal. These sidebands, along with the remainder of the composite signal produced at the output of composite signal amplifier 102, are supplied in push-pull fashion to a first balanced synchronous subcarrier detector 108. The appropriate 38 KHz subcarrier signal provided by oscillator 104 is also coupled in push-pull fashion to detector 108. Detector 108 provides push-pull outputs balanced against both of its push-pull inputs and including audio frequency components corresponding to (L-R) and −(L-R) information.

Oscillator 104 is also arranged to provide a second 38 KHz subcarrier wave in quadrature relationship with the first. The quadrature 38 KHz subcarrier is supplied in push-pull fashion to a quadrature 38 KHz synchronous detector 110. Push-pull composite signals are also supplied to detector 110 from amplifier 102. Detector 110, like detector 108, provides push-pull outputs balanced against both input signals. Audio frequency components of the outputs of detector 110 correspond to (F-B) and −(F-B) information.

It should be noted that the AM sidebands associated with the quadrature subcarrier occupy the same frequency spectrum (23 KHz to 53 KHz) as the conventional stereophonic difference (L-R) signal sidebands. Because of the quadrature relationship of the two subcarriers, the two difference signals readily may be separated by means of the illustrated synchronous detectors. Therefore, no additional frequency spectrum is required for the described system.

The audio frequency components of the composite signal provided by amplifier 102, as noted previously, comprise a $L_f+R_f+R_r+L_r$ signal. This composite signal is added to a selected one of the outputs of each of synchronous detectors 108 and 110 in each of the summing networks 112, 114, 116 and 118 to form signals having audio frequency components proportional, respectively, to $L_f'$, $R_f'$, $L_r'$ and $R_r'$ as previously defined in connection with FIG. 1. These signals are supplied to appropriate loudspeakers 120, 122, 124 and 126 arranged, for example, in a corresponding square around a listener's location in a room.

Additional functions may be provided in the receiver shown in FIG. 2. For example, normal stereophonic indicating and switching means may be and preferably are provided. In addition, means may be provided for distinguishing between two-channel stereophonic and surround stereophonic information and for appropriately switching excitations of the speakers depending upon the type signal received. Such apparatus is described in U.S. patent application Ser. No. 251,771 now U.S. Pat. No. 3,787,629, (RCA 63,878) filed concurrently herewith in the name of Allen LeRoy Limberg. It will also be recognized that conventional amplifiers and de-emphasis networks (not shown) as well as volume and tone control circuits appropriately may be provided in the receiver.

It should be noted that, in the preceding discussion, no mention is made of a fourth combination of four signals $L_f$, $R_f$, $R_r$ and $L_r$ defined as follows:

$$Z=L_f+R_r-R_f-L_r$$

It has been observed that, absent this fourth signal, the described system provides localization of sound sources without anomalies as noted above. Inclusion of the fourth signal would serve only to eliminate cross-coupling to flanking speakers for the case where, in the original sound field, a source existed only in one of the diagonal ($L_f$, $R_f$, $R_r$, $L_r$) directions. In the described three channel transmission system, such a sound field condition results in energization of three speakers, one corresponding to the direction of the original sound source and the other two flanking the one. The flanking speakers, as noted above, are energized with equal signals which are less than that applied to the principal speaker. It has been observed that such a condition does not change the subjective impression of a centrally located listener. Such positioning of a listener is normal and should be expected since, in order to produce phantom sound sources at locations between the speakers, (in the manner of a center soloist in two-channel stereo), it must be presumed a listener is located approximately centrally with respect to all four walls. Otherwise, the recreation of such phantom sound sources will be unsuccessful.

What is claimed is:

1. In a three-channel system for reproduction of sound field information surrounding a listener including a plurality of sound sources disposed in four spatial quadrants, said system comprising:

(a) means for providing a first electrical signal (M) representative of the sum of the amplitudes of sound signals produced by said plurality of sources, (b) means for providing a second electrical signal (X) representative of the sum of amplitudes of sound source signal components directed along a pair of orthogonal axes in a first pair of adjacent spatial quadrants minus the sum of amplitudes of sound source signal components directed along said axes in a second pair of adjacent spatial quadrants, said second pair of quadrants being adjacent to said first pair, (c) means for providing a third electrical signal (Y) representative of the sum of amplitudes of sound source signal components directed along said axes in a first quadrant of said first pair and an adjacent second quadrant of said second pair minus the sum of amplitudes of sound source signal components directed along said axes in a second quadrant of said first pair and an adjacent first quadrant of said second pair, and (d) only first, second and third signal transmission channels for transmission of sound information from said sources having inputs coupled, respectively, to said means for providing first, second and third electrical signals;

apparatus comprising the combination of:

at least four sound signal output terminals suitable for coupling to respectively different ones of an array of sound reproducing loudspeakers, and signal combining means responsive to only the outputs of said first, second and third signal transmission channels for supplying to each of said sound signal output terminals a signal proportional to the output of said first channel and for supplying to each of said sound signal output terminals a respectively different linear combination of signals proportional to outputs of said second and third channels, said combinations being determined according to an intended spatial orientation of the loudspeakers of said array relative to the spatial orientation of said orthogonal axes, and weighted relative to said supplied signal proportional to the output of said first channel such that, in reproduction of sound originating from only a single one of said quadrants, sound emanation from the opposed quadrant is substantially suppressed.

2. Apparatus according to claim 1, in a system wherein:

said first and second quadrants of said first pair corresponds, respectively, to left front and right front positions and said first and second quadrants of said second pair correspond, respectively, to right rear and left rear positions in a sound field.

3. Apparatus according to claim 2, in a system wherein:

said orthogonal axes extend from left front to right rear and from right front to left rear in said sound field.

4. Apparatus according to claim 1 wherein:

said signal combining means supplies: (1) to a first of said sound signal output terminals a signal, corresponding to the sum of signals proportional to outputs from said first, second and third channels, (2) to a second of said sound signal output terminals a signal (formed by) corresponding to the sum of signals proportional to outputs from said first and second channels minus a signal proportional to the output of said third channel, (3) to a third of said sound signal output terminals a signal corresponding to the sum of signals proportional to outputs from said second and third channels minus a signal proportional to the output of said first channel, and (4) to a fourth of said sound signal output terminals a signal corresponding to the sum of signals proportional to the outputs of said first and third channels minus a signal proportional to the output of said second channel.

5. Apparatus according to claim 4 also including:

first, second, third and fourth loudspeakers coupled respectively to said first, second, third and fourth signal output terminals, and oriented, respectively, in left front, right front, right rear and left rear positions relative to a listener.

6. A multiplex system for reproduction of information representative of a sound field surrounding a listener comprising:

means for supplying a composite surround sound field signal comprising an audio sum signal component, a fixed frequency pilot signal, a first audio difference signal component impressed as amplitude modulation of a first suppressed subcarrier, the subcarrier being in second harmonic relation with said pilot signal and in predetermined time relation therewith, and a second audio difference signal component in orthogonal spatial relation with said first difference signal component, said second difference signal component being impressed as amplitude modulation of a second suppressed subcarrier, the second subcarrier being equal in frequency to, but in quadrature phase relation, with respect to said first subcarrier, to the exclusion of any additional audio difference signal component;

first and second synchronous detection means coupled to said composite signal supplying means for recovering said first and second audio difference signal components; and signal combining means coupled to said first and second synchronous detection means and to said composite signal supplying means for combining only said audio sum signal component and said first and second difference signal components to provide a plurality of signals adapted for application to a plurality of loudspeakers disposed in a given spatial distribution pattern about a listening area to recreate a sound field surrounding a listener;

wherein said first audio difference signal component corresponds to left front plus right front minus left rear minus right rear audio signal components and said second audio difference signal component corresponds to left front plus left rear minus right front minus right rear audio signal components; and wherein the combining of said first and second difference signal components with said sum signal component in said signal combining means is effected with such relative weighting of said components that, in reproduction of sound originally emanating from a single one of said left front, right front, left rear and right rear positions, sound emanation from the opposite one of said positions is substantially precluded.

7. A multiplex system according to claim 6 wherein: said audio sum signal component corresponds to left front plus right front plus right rear plus left rear audio signal components.

8. A multiplex system according to claim 7 wherein: said pilot signal is at a frequency of 19 KHz and said subcarriers are at a frequency of 38 KHz, said second subcarrier is timed with respect to said pilot such that alternate average axis crossings of said second carrier coincide with average axis crossings of said pilot signal, said first subcarrier being in quadrature relation with said second subcarrier.

9. A multiplex system according to claim 6 and further comprising:

a plurality of loudspeakers disposed in said given spatial distribution pattern about a listening area, coupled to said signal combining means and responsive to output signals therefrom for recreating a sound field surrounding a listener.

10. In a three-channel system for reproduction of sound field information surrounding a listener including a plurality of sound sources disposed in four spatial quadrants, said system comprising:

(a) means for providing a first electrical signal (M) representative of the sum of the amplitudes of sound signals produced by said plurality of sources, (b) means for providing a second electrical signal (X) representative of the sum of amplitudes of sound source signal components directed along a first axis lying at the intersection of a first pair of adjacent spatial quadrants minus the sum of amplitudes of sound source signal components directed along said axis in the remaining pair of spatial quadrants, said remaining pair of quadrants being opposite to said first pair, (c) means for providing a third electrical signal (Y) representative of the sum of amplitudes of sound source signal components directed along a second axis orthogonal to the first, said axis lying at the intersection of a first quadrant of said first pair and a second quadrant of said remaining opposite pair, minus the sum of amplitudes of sound source signal components directed along said second axis in a second quadrant of said first pair and a first quadrant of said remaining opposite pair, and (d) only first, second and third signal transmission channels for transmission of sound information from said sources having inputs coupled, respectively, to said means for providing first, second and third electrical signals;

apparatus comprising the combination of:

at least four sound signal output terminals suitable for coupling to respectively different ones of an array of sound reproducing loudspeakers, and signal combining means responsive to only the outputs of said first, second and third signal transmission channels for supplying to each of said sound signal output terminals a signal proportional to the output of said first channel and for supplying to each of said sound signal output terminals a respectively different linear combination of signals proportional to outputs of said second and third channels, said combinations being determined according to an intended spatial orientation of the loudspeakers of said array relative to the spatial orientation of said orthogonal axes, and weighted relative to said supplied signal proportional to the output of said first channel such that, in reproduction of sound originating from only a single one of said quadrants, sound emanation from the opposite quadrant is substantially suppressed.

11. Apparatus according to claim 10, in a system wherein:

said first and second quadrants of said first pair corresponds, respectively, to left front and right front positions and said first and second quadrants of said remaining pair correspond, respectively, to right rear and left rear positions in a sound field.

12. A system for reproduction of sound field information surrounding a listener including a plurality of sound sources disposed in four spatial quadrants comprising:

means for providing a first electrical signal (M) representative of the sum of the amplitudes of sound signals produced by said plurality of sources, means for providing a second electrical signal (X) representative of the sum of amplitudes of sound source signal components directed along a first axis lying at the intersection of a first pair of adjacent spatial quadrants minus the sum of amplitudes of sound source signal components directed along said axis in the remaining pair of spatial quadrants, said remaining pair of quadrants being opposite to said first pair, means for providing a third electrical signal (Y) representative of the sum of amplitudes of sound source signal components directed along a second axis orthogonal to the first, said axis lying at the intersection of a first quadrant of said first pair and a second quadrant of said remaining opposite pair, minus the sum of amplitudes of sound source signal components directed along said second axis in a second quadrant of said first pair and a first quadrant of said remaining opposite pair, first, second and third signal transmission channels having inputs coupled, respectively, to said means for providing first, second and third electrical signals, at least four sound reproducing loudspeakers, and signal combining means coupled between said first, second and third signal transmission channels and said loudspeakers for supplying to each of said loudspeakers a signal proportional to the output of said first channel and for supplying to selected ones of said loudspeakers additive and subtractive linear combinations of signals proportional to outputs of said second and third channels, said combinations being determined according to spatial orientation of said loudspeakers relative to spatial orientation of said orthogonal axes.

13. A system according to claim 12 wherein:

said first and second quadrants of said first pair corresponds, respectively, to left front and right front positions and said first and second quadrants of said remaining pair correspond, respectively, to right rear and left rear positions in a sound field.

* * * * *

UNITED STATES PATENT AND TRADEMARK OFFICE

CERTIFICATE OF CORRECTION

PATENT NO. : 4,316,058

DATED : February 16, 1982

INVENTOR(S) : Roy M. Christensen

It is certified that error appears in the above—identified patent and that said Letters Patent is hereby corrected as shown below:

Column 10, lines 21-68: Claims 12 and 13 should be deleted.

Signed and Sealed this

*Eighteenth* Day of *May 1982*

[SEAL]

*Attest:*

GERALD J. MOSSINGHOFF

*Attesting Officer*

*Commissioner of Patents and Trademarks*